United States Patent [19]

Adelman et al.

[11] 4,335,185

[45] Jun. 15, 1982

[54] INDIGO-DYEABLE POLYESTER FIBERS

[75] Inventors: Robert L. Adelman; John J. P. Turner, both of Wilmington, Del.

[73] Assignee: E. I. Du Pont de Nemours and Company, Wilmington, Del.

[21] Appl. No.: 220,809

[22] Filed: Dec. 29, 1980

[51] Int. Cl.[3] ..... D02G 3/00

[52] U.S. Cl. ..... 428/361; 8/115.6; 428/395

[58] Field of Search ..... 428/375, 395, 394, 361, 428/359, 288, 224, 364; 8/115.6; 525/58, 61

[56] References Cited

U.S. PATENT DOCUMENTS 3,105,058 9/1963 Osugi et al. ..... 525/58 X 3,147,233 9/1964 Mendelsohn et al. ..... 8/115.6 X 3,166,886 1/1965 Kretsch ..... 8/DIG. 4

3,630,831 12/1971 Jongetjes .

3,644,081 2/1972 Matsuda et al. ..... 8/115.6

OTHER PUBLICATIONS

Hercules Technical Data Bulletin, OR212A.

Tappi Monograph Series No. 29, "Wet Strength in Paper and Paperboard", 1965, pp. 33–37.

Chemical Abstracts, vol. 85, No. 12 and 5, (1976).

*Primary Examiner*—Lorraine T. Kendell

[57] ABSTRACT

Cross-linked polyvinyl alcohol coated polyester fiber is indigo-dyeable and exhibits wash-down and crocking resistance characteristics similar to indigo-dyed cotton fibers.

4 Claims, No Drawings

INDIGO-DYEABLE POLYESTER FIBERS

BACKGROUND OF THE INVENTION

This invention relates to coated polyester fibers which are indigo-dyeable and possess wash-down and crocking resistance characteristics similar to indigo-dyed cotton fibers and to a process for preparing such fibers.

Indigo-dyed denim fabrics are twill fabrics in which only the warp yarns are dyed. For reasons of style, it is desired not only that these fabrics have an initial deep indigo blue color, but also that the fabrics begin to fade in an obvious manner after only a few wearings and launderings. For stronger, more durable fabrics with better fabric stability than all-cotton fabrics, blends of polyester staple fibers with cotton have been used. The undyed filling yarns can be made of 50/50 polyester/-cotton blends for high strength. However, since commercially available polyester fibers will not dye with indigo, it has been found that the warp yarns can contain only a small amount of polyester fibers—only about 10 wt. % in open-end-spun yarns and no more than about 25 wt. % in ring-spun yarns—if the desired deep blue color is to be obtained. At higher blend levels, it becomes increasingly difficult to make a fabric which can be dyed to an acceptable indigo shade.

The use of polyaminoalkylsilanes to coat either natural or synthetic fibers so that they will be dyeable with a wide variety of dyestuffs has been disclosed by Speier in his U.S. Pat. No. 3,504,998. The polymerization of unsaturated compounds containing polyalkylene oxide segments onto polyester, polyamide, and polyacrylonitrile fibers to provide them with indigo-dyeable surfaces is described by Toray Industries, Inc., in their Japanese patent application (Kokai) 77778/79. However, polyester staple fibers adapted for indigo dyeability with wash-down and fading characteristics adequately simulating indigo-dyed cotton fibers have not been described by the prior art.

SUMMARY OF THE INVENTION

The present invention comprises a process for preparing indigo-dyeable polyester fiber comprising applying a coating of polyvinyl alcohol and a material capable of cross-linking polyols via ether linkages to polyester fiber and curing the coating whereby the polyvinyl alcohol is cross-linked. The cross-linking material is a water-soluble polyamide containing secondary amino groups in the polymer chain which have been reacted with epichlorohydrin (PAA). The coating may also contain blue dye and carbon black pigment. The invention is also directed to the indigo-dyeable fiber coated with the cross-linked polyvinyl alcohol and the water-soluble polyamide whether it be in the form of a multifilament tow, a loose batt of staple fiber, a yarn of staple fiber or a fabric of such yarn. It further comprehends the fiber which is coated with the polymeric coating agent and has the indigo dye present in the coating.

DETAILED DESCRIPTION OF THE INVENTION

In the practice of the present invention, polyester fiber is coated with polyvinyl alcohol and a material that is effective for cross-linking the polyvinyl alcohol via ether linkages. The molecular weight of the polyvinyl alcohol (PVA) can be between about 40,000 and 115,000. PVA hydrolysis level can be between about 88 and 100%. Preferably the PVA has a molecular weight of about 115,000 and 100% hydrolysis level for the most abrasion resistant coatings after curing. Commercially available PVA of 60,000–70,000 molecular weight and 98.5% hydrolysis has been found to give satisfactory results. PVA is unusual in that, after cross-linking, it indigo-dyes similar to cotton, although not as deeply, and has cotton-like wash-down.

For cross-linking the polyvinyl alcohol via ether linkages there is used certain water-soluble polyamides of the type discussed in TAPPI Monograph Series No. 29, "Wet Strength in Paper and Paperboard", 1965, p. 33 and U.S. Pat. Nos. 2,926,116 and 2,926,154. A commercially available product identified as "Polycup" Grade 172 (see Hercules Technical Data Bulletin OR-212A) (PAA) is used in the examples below. This material rapidly cross-links PVA under mild conditions to abrasion resistant coatings that indigo-dye and wash-down. The cross-linking is believed to occur as follows:

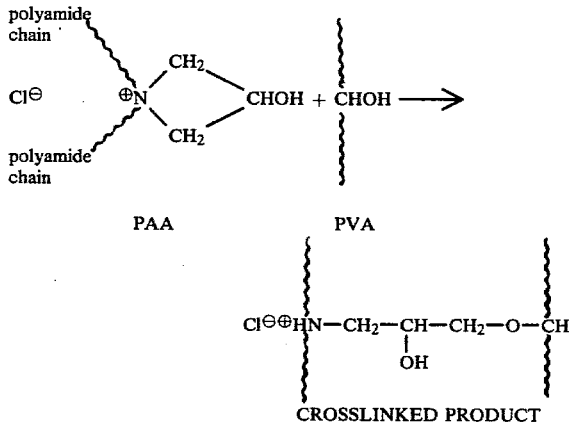

The ratio of PVA to water-soluble polyamide may vary between about 80/20 and 95/5 wt. ratio of active ingredients to give good dry and wet coating-abrasion resistance with 95/5 being preferred for economic reasons. Coating levels of between about 0.25 and 2% of cross-linked product of PVA and water soluble polyamide (on wt. fiber) are acceptable with about 0.5–1% preferred because it minimizes fabric stiffening and is the least costly. The coating mixture should be maintained below about 65° C., preferably near room temperature, before application to prevent premature cross-linking and gelation. After the coating composition has been applied to the fiber, the fibers may be dried and the coating cured. Temperature/times of 120°–140° C. for about 5–10 minutes have given good coating durability and wash-down performance.

In another embodiment of the invention, a blue dye and carbon black are included in the coating composition. The pigments help the indigo-dyed polyester fiber to simulate indigo-dyed cotton yarn. The preferred blue dye is Color Index (C.I.) Disperse Blue 56 dye. It and the carbon black pigment can be used at levels between about 0.25 and 2.5%, and between about 0.01 and 0.75% on wt. fiber, respectively, with the exact level being chosen to give the desired final dye shade. About 1.5% Disperse Blue 56 dye and about 0.5% carbon black are preferred because they provide good dye shade depth and purity in indigo-dyed open end spun 50/50 coated polyester/uncoated cotton warp yarn.

A desirable property of the Disperse Blue 56 dye in the process described herein is that it has low thermosol energy requirements. It can thermosol at modest temperatures into the polyester fibers on the yarn surface, e.g., at about 160°-165° C. yarn surface temperature, thereby improving as-finished shade depth and purity substantially. Temperatures in this range can be achieved by either warp or fabric singeing using an open flame, radiant heat, hot air or heated rolls. Other useful blue and black dyes are "Resolin" Blue GFL dye/carbon black, C.I. Leuco Sulfur Blue 19 dye/carbon black, C.I. Disperse Blue 56 dye/C.I. Acid Black 170 dye and C.I. Disperse Blue 56 dye/C.I. Acid Black 132 dye.

The following examples will illustrate how the invention is carried out in practice.

EXAMPLE 1

Coating Application, Yarn and Fabric Preparation

Using a spray-draw machine of the type generally disclosed by Paulsen in U.S. Pat. No. 2,918,346, a tow comprising a multiplicity of poly(ethylene terephthalate) continuous filaments having an as-spun linear density of about 0.47 tex per filament (about 4.2 dpf) was passed through a 45° C. preheating bath and drawn 2.8X in the spray-drawn zone at 98° C. After leaving the draw rolls of the spray-draw machine, the tow, running at 393 g/min, was coated with an aqueous solution containing polymeric coating agent (344 g of 70,000 M.W., 98.5% hydrolyzed poly[vinyl alcohol], 686 g of a 12.5% aqueous solution of a water soluble polyamide containing secondary amino groups in the polymer chain which have been reacted with epichlorohydrin, and 24.25 l. water) by pumping it at a rate of 75 ml/min into a stuffer-box crimper maintained at 90° C. and then laid on a continuous belt and passed through an elongated heating chamber wherein it was subjected to a maximum temperature of 140° C., the residence time of the tow in the chamber being 6 minutes to cross-link the coating. Based on the rate of application of the polymeric coating agent to the tow, and the wet pick-up of the tow, it was calculated that the tow contained 0.3% of the dried polymeric coating agent on wt. of tow. The tow was then cut into a loose batt of staple fibers having a cut length of 3.8 cm (1.5 inch), carded, and ring-spun into 227 dtex (26 singles cotton-count, 204 denier) yarns having 7.56 turns per cm (19.2 turns per inch) of "Z" twist. The yarns were knit into a jersey-knit tubing on a circular knitting machine (manufactured by Lawson-Hemphill, Inc.) and heat-set at 180° C. for 2 minutes.

Uncoated tow, spun yarn and jersey knit were prepared as above, except coating application was omitted.

Knit samples were indigo dyed as follows.

Reduced Indigo-Dye Bath Preparation. An indigo-dye bath was prepared in a four-neck, two-liter round bottom flask under a nitrogen flow by dissolving 8.1 g sodium hydroxide in 990 ml water, adding and dissolving 2.25 g sodium hydrosulfite, adding 1.5 g indigo powder, and heating at 50°-60° C. (122°-140° F.) for 1 to 2 hours followed by allowing the mixture to stand overnight at room temperature under a nitrogen flow to fully reduce the indigo and give a clear brownish-yellow solution. Additional sodium hydrosulfite was added as required to clear the solution.

Indigo-Dyeing Procedure. To avoid cross-contamination, fresh baths were used for each fabric sample. The sample was first scoured at the boil for 30 seconds in 200 ml of water containing 8.0 g/l of a penetrating agent comprising a fatty alcohol sulfate sodium salt. The fabric was then squeezed to 150% wet pick-up, rinsed for 10 seconds in 200 ml of cold water, and squeezed again. In each case the squeezing procedure consisted of quickly folding the fabric sample twice (so that the sample then comprised four thicknesses of fabric), placing the folded fabric sample between a pair of 15×15 cm sheets of polyester film to form a fabric sample/film assembly, and passing the assembly through a laundry wringer with the wringer tension set to result in about 150% wet pick-up in the fabric after one 5-second pass through the wringer. A quantity of 250 ml of the reduced indigo solution at room temperature, prepared as described above, was transferred via a nitrogen purged syringe from the two-liter flask to a 500 ml, two-neck, round bottom flask maintained under a rapid nitrogen flow. The fabric sample was placed beneath the surface of the dye solution for 90 seconds, after which it was removed and squeezed to 150% wet pick-up, using the squeezing procedure previously described. The fabric was then exposed to a stream of air by hanging it vertically in a running hood for 3.0 minutes. The procedure of dyeing the fabric and then exposing it to a stream of air was performed a total of six times each, after which the fabric was rinsed for one minute in 1000 ml of cold water in a beaker and subjected to the squeezing procedure previously described. Finally, the fabric was agitated for one minute at 60° C. (140° F.) in 200 ml of water containing 2.25 g/l of a softener comprising a saturated hydrocarbon sodium sulfonate composition. The fabric was again subjected to the squeezing procedure previously described and hung in the hood to dry. The dye-shade rating of the fabric sample, "$R_{as\text{-}dyed}$", was measured as described below.

Wash-down Procedure. The as-dyed fabric samples were washed once each in an automatic washer (Sears Model 600) using a high level of hot water, and one cup of detergent ("Tide"). The samples were air dried in a running hood at room temperature. The dye-shade rating of the laundered fabric, "$R_{washed}$", was then measured as described below.

Dye-Shade Rating. Each dry fabric sample was folded twice, with the face of the fabric on the outside, so that the sample then comprised four thicknesses of fabric with one quarter of the face of the fabric sample up. The folded fabric sample was placed on a piece of white paper and its shade depth was measured with a reflectance densitometer (Macbeth Model RD-514 Reflectance Densitometer, using the blue dot filter position). Five measurements were made, one in each corner and one in the center. The fabric was then refolded to expose a different quarter of the face of the fabric sample, and five more measurements were taken. A total of 10 measurements was taken, and the average of the 10 values was multiplied by 100 and recorded as R, the experimental dye-shade rating for an individual fabric sample, with $R_{as\text{-}dyed}$ representing the dye-shade rating of the as-dyed fabric, and $R_{washed}$ representing the dye-shade rating of the as-dyed fabric after one wash as described above. The values of % wash-down are calculated using the following equation:

$$\%\ \text{Wash-down} = \frac{R_{as\text{-}dyed} - R_{washed}}{R_{as\text{-}dyed} - R_{undyed}} \times 100\%$$

where $R_{as\text{-}dyed}$ and $R_{washed}$ are as described above and $R_{undyed}$ represents the color rating of uncoated fabric before dyeing. $R_{undyed}$ varied from 15.7 to 16.6 depending on the sample measured, and an average value of 16.2 was used in most of the work.

Results are summarized in Table 1.

TABLE I

| Coating | $R_{As\text{-}Dyed}$ | $R_{Washed}$ | % Wash-Down |
|---|---|---|---|
| None | 83 | 59 | 36 |
| 0.3% Cross-linked Poly(vinyl alcohol) above | 98 | 77 | 25 |

EXAMPLE 2

Single jersey-knit fabric samples, each measuring 30.5×30.5 cm, were coated with polymeric coating agent, dyed with indigo dye, and evaluated for dye pick-up and for percentage loss of dye during subsequent laundering. The results are reported in Table II. The fabric samples had a basis weight of 145 g/m$^2$ (4.3 oz/yd$^2$) and were made of 78 dtex (70 denier) poly(ethylene terephthalate) spun yarn comprised of 1.7 dtex per filament (1.5 denier per filament) staple fibers of round cross-section. The fabric sample was immersed in 100 ml of an aqueous coating mixture, agitated to ensure complete wetting of the fabric, removed from the bath, wrung out by hand, and blotted with paper towels to 100% wet pick-up. The coated fabric sample was dried horizontally in a hood until its wet pick-up decreased to about 20%. It was then further dried/-cured in a 140° C. forced air oven for about 10 minutes.

The knit samples were indigo dyed, washed and their colors measured as in Example I. The results are summarized in Table II. The PVA used had a molecular weight of about 70,000 and was 98.5% hydrolyzed. The water-soluble polyamide (PAA) was that described above.

TABLE II

INDIGO-DYEABLE CROSS-LINKED COATINGS ± DYES/PIGMENTS ON POLYESTER KNITS

| Coating* | $R_{As\text{-}Dyed}$ | $R_{Washed}$ | % Wash-Down | As-Dyed Color to the Eye |
|---|---|---|---|---|
| None | 84 | 57 | 39 | Light blue |
| A | 114 | 106 | 9 | Medium blue |
| B | 125 | 112 | 12 | Dark blue |
| C | 120 | 103 | 16 | Dark blue |
| D | 126 | 106 | 18 | Dark blue |
| E | 132 | 118 | 12 | Very dark blue |
| F | 112 | 96 | 17 | Medium blue |
| G | 121 | 103 | 17 | Dark blue |

*Coating compositions are % active ingredient on weight of uncoated fabric plus a small amount of a poly(ethylene oxide) based wetting agent.
A PVA/PAA (0.95/0.05)
B PVA/PAA/C.I. Disperse Blue 56 dye/Carbon Black (0.475/0.025/1.5/0.25)
C Same as coating B except (0.5/0.1/1.5/0.25)
D PVA/PAA/"Resolin" Blue GFL disperse dye of Mobay Chemical Co./Carbon Black (0.5/0.1/1.5/0.25)
E PVA/PAA/C.I. Leuco Sulfur Blue 19 dye/Carbon Black (0.5/0.1/1.5/0.25)
F PVA/PAA/C.I. Disperse Blue 56 dye/C.I. Acid Black 170 dye (0.5/0.1/1.5/0.25)
G PVA/PAA/C.I. Disperse Blue 56 dye/C.I. Acid Black 132 dye (0.5/0.1/1.5/0.25)

We claim:

1. Indigo-dyeable polyester fiber comprising polyester fiber coated with the cross-linked product of polyvinyl alcohol and a water-soluble polyamide containing secondary amino groups in the polymer chain which have been reacted with epichlorohydrin.

2. The fiber of claim 1 wherein the ratio of polyvinyl alcohol to water-soluble polyamide is in the range of between 80/20 and 95/5 wt. ratio and the cross-linked coating constitutes between about 0.25 and 2% by weight of the fiber.

3. The fiber of claim 2 wherein the coating additionally contains a blue dye and carbon black.

4. A loose batt of staple fiber from the coated fiber of claim 1.

* * * * *